US011448040B2

(12) United States Patent
El Mallawany et al.

(10) Patent No.: US 11,448,040 B2
(45) Date of Patent: Sep. 20, 2022

(54) FLUID LOSS DEVICE INCLUDING A SELF-OPENING UPSIDE DOWN FLAPPER VALVE

(71) Applicant: Halliburton Energy Services, Inc., Houston, TX (US)

(72) Inventors: Ibrahim El Mallawany, Dhahran (SA); Francois Chevallier, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/125,347

(22) Filed: Dec. 17, 2020

(65) Prior Publication Data

US 2022/0195838 A1 Jun. 23, 2022

(51) Int. Cl.
*E21B 34/08* (2006.01)
*E21B 43/26* (2006.01)

(52) U.S. Cl.
CPC ..... *E21B 34/08* (2013.01); *E21B 43/26* (2013.01); *E21B 2200/05* (2020.05); *E21B 2200/08* (2020.05)

(58) Field of Classification Search
CPC ..... E21B 34/08; E21B 43/26; E21B 2200/05; E21B 2200/08
See application file for complete search history.

(56) References Cited

U.S. PATENT DOCUMENTS

| | | | | |
|---|---|---|---|---|
| 6,732,803 | B2 | 5/2004 | Garcia et al. | |
| 10,267,120 | B1 | 4/2019 | Roane et al. | |
| 2006/0283791 | A1 | 12/2006 | Ross | |
| 2011/0155380 | A1 | 6/2011 | Frazier | |
| 2012/0006553 | A1 | 1/2012 | Korkmaz | |
| 2016/0177668 | A1 * | 6/2016 | Watson | E21B 21/10 166/373 |

FOREIGN PATENT DOCUMENTS

| | | | | |
|---|---|---|---|---|
| EP | 3521552 | A2 | 8/2019 | |
| WO | 2017151126 | A1 | 9/2017 | |
| WO | WO-2020096568 | A1 * | 5/2020 | E21B 33/14 |

* cited by examiner

*Primary Examiner* — James G Sayre
(74) *Attorney, Agent, or Firm* — Scott Richardson; Parker Justiss, P.C.

(57) ABSTRACT

Provided is a fluid loss device, a well system, and a method for fracturing a well system. The fluid loss device, in this aspect, includes a dissolvable member coupled to an opening sleeve, the dissolvable member operable to fix the opening sleeve in a first opening sleeve position when an internal prop sleeve is in the first prop sleeve position and for a period of time after the internal prop sleeve moves to the second prop sleeve position, and then dissolve triggering the opening sleeve to move from the first opening sleeve position to the second opening sleeve position.

25 Claims, 6 Drawing Sheets

FLUID LOSS DEVICE INCLUDING A SELF-OPENING UPSIDE DOWN FLAPPER VALVE

BACKGROUND

The process of induced hydraulic fracturing involves injecting a fracturing fluid at a high pressure into a fracturing zone of interest. Small fractures are formed, allowing fluids, such as gas and petroleum to migrate into the wellbore for producing to the surface. Often the fracturing fluid is mixed with proppants (e.g., sand) and chemicals in water so that once the pressure is removed, the sand or other particles hold the fractures open. Other fracturing fluids use concentrated acid to dissolve parts of the formation so that once the pressure is removed, dissolved tunnels are formed in the formation. Hydraulic fracturing is a type of well stimulation, whereby the fluid removal is enhanced, and well productivity is increased.

Multi-stage hydraulic fracturing is an advancement to produce fluids along a single wellbore or fracturing string. Multiple stages allow the fracturing fluid to be targeted at individual zones. Zones are typically fractured in a sequence, for example toe to heal. In a multi-stage fracturing process, previously fractured zones are isolated from the zones that are going to be stimulated. Upside down flapper valves are often used to isolate a particular zone of interest from the previously fractured zones.

BRIEF DESCRIPTION

Figure 1:
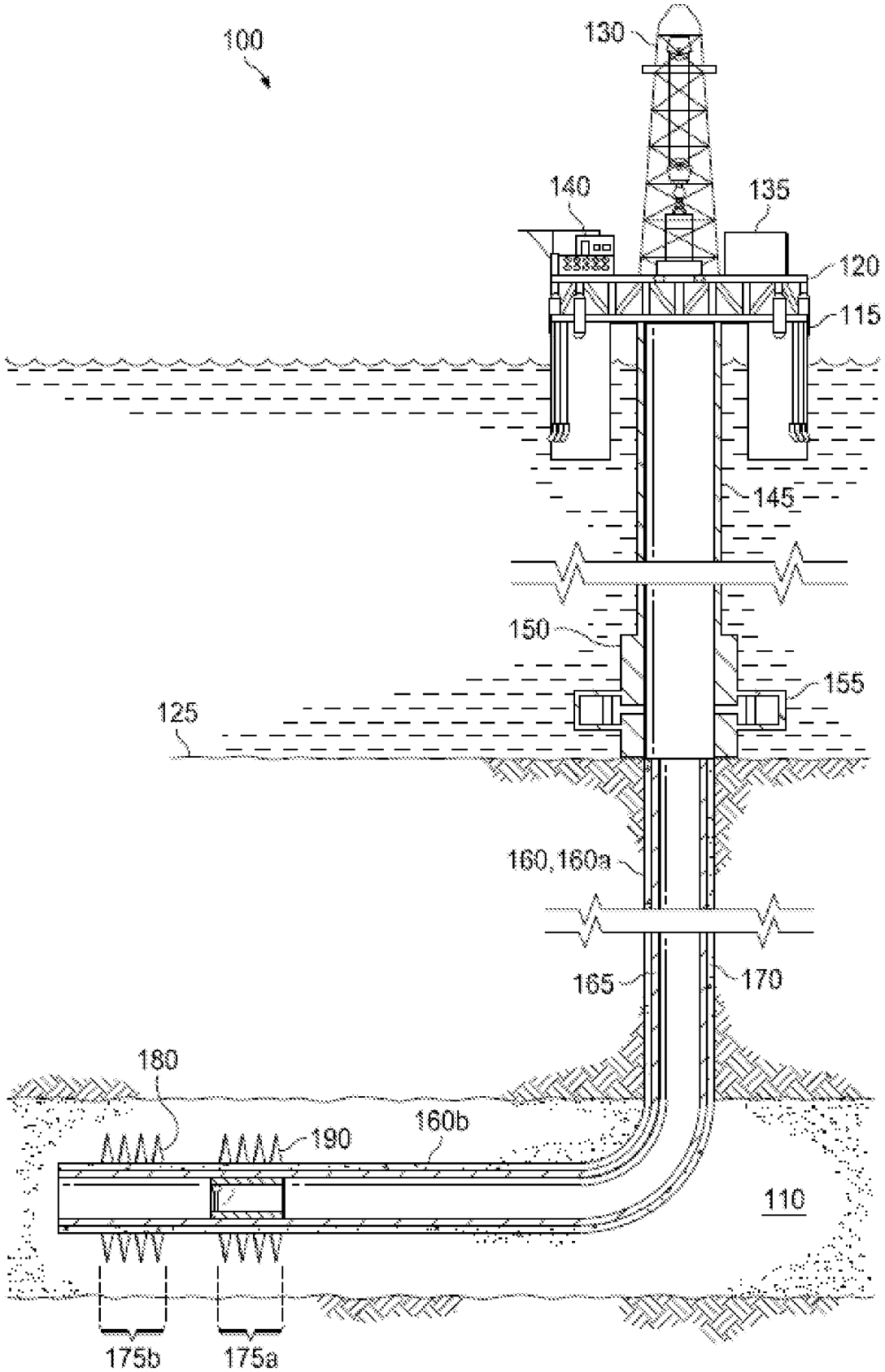
Figure 2:
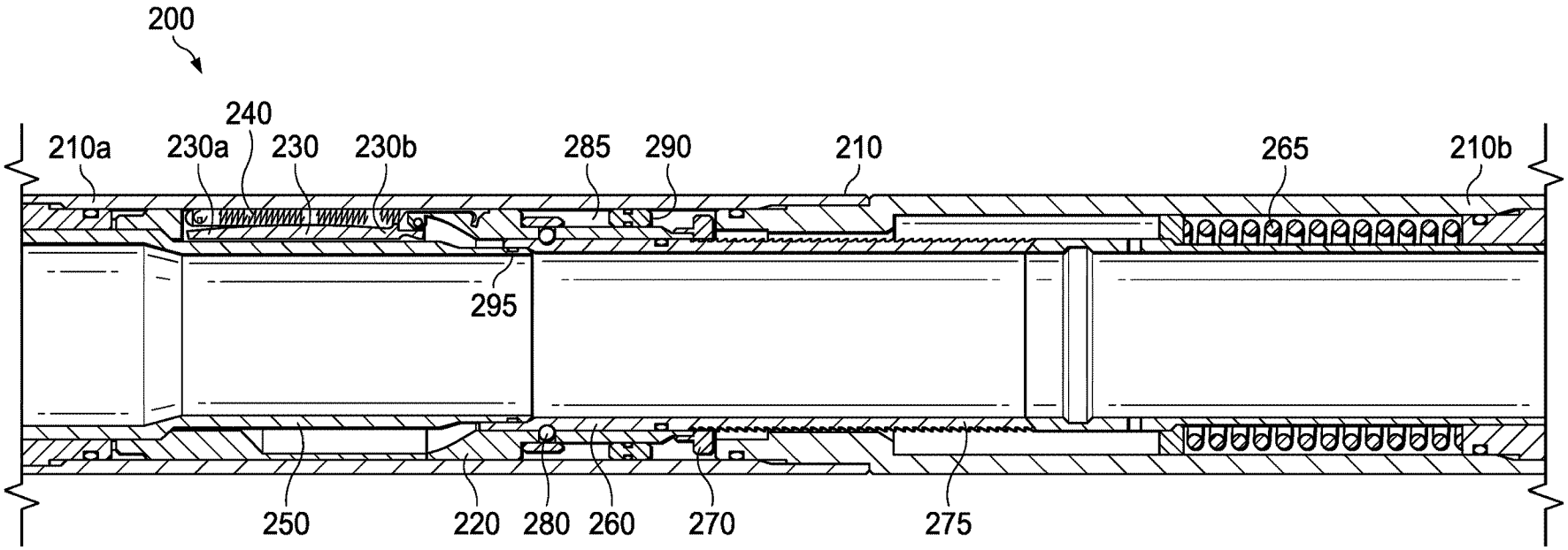

Reference is now made to the following descriptions taken in conjunction with the accompanying drawings, in which:

FIG. 1 schematically illustrates a well system including a fluid loss device designed, manufactured and operated according to the present disclosure;

FIG. 2 schematically illustrates a fluid loss device designed, manufactured, and operated according to one embodiment of the disclosure; and FIGS. 3 through 6, schematically illustrates a fluid loss device designed, manufactured and operated according to the present disclosure, at various different steps of fracturing a well system.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different form.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

In some well systems, the application of pressure to remotely open an upside down flapper of a fluid loss devices is not possible. Accordingly, the industry has moved toward a design that relies upon maintaining pressure on the upside down flapper, and a spring actuated opening sleeve. The present disclosure, however, has recognized that situations arise wherein it is difficult to maintain the pressure on the upside down flapper, and in those situations the spring actuated opening sleeve undesirably moves the upside down flapper back to the open position, which at times can be difficult to reverse. Specifically, the present disclosure has recognized that the swabbing effect of withdrawing downhole tools uphole within the wellbore can cause the pressure on the upside down flapper to unintentionally drop, thus resulting in the premature opening of the upside down flapper. In other applications it may not be possible to apply pressure on the flapper such as fracking with a coiled tube.

The present disclosure, based at least part on these recognitions, has developed a fluid loss device that does not experience the pressure and timing issues discussed above. Specifically, the present disclosure has developed a fluid loss device with a dissolvable member that only gets exposed to activation fluid after the upside down flapper initially shifts from the open position to the closed position. Accordingly, depending on the materials used and design, the dissolvable member can provide a period of time before the spring actuated opening sleeve is triggered. The period of time may range greatly based upon the dissolvable material selected, potential coating on the dissolvable material, and the general design of the dissolvable member. In certain embodiments, the period of time may range from about one hour to about 10 days. In other embodiments, the period of time is from two hours to two days Referring initially to FIG. 1, schematically illustrated is a well system 100 including a fluid loss device 190 designed, manufactured and operated according to the present disclosure, and positioned at a desired location in a subterranean formation 110. The well system 100 of FIG. 1, without limitation, includes a semi-submersible platform 115 having a deck 120 positioned over the submerged oil and gas formation 110, which in this embodiment is located below sea floor 125. The platform 115, in the illustrated embodiment, may include a hoisting apparatus/derrick 130 for raising and lowering work string, as well as a fracturing pump 135 for conducting a fracturing process of the subterranean formation 110 according to the disclosure. The well system 100 illustrated in FIG. 1 additionally includes a control system 140 located on the deck 120. The control system 140, in one embodiment, may be used to control the fracturing pump 135, as well as may be communicatively, e.g., electrically, electromagnetically or fluidly, coupled to other downhole features.

A subsea conduit 145 extends from the platform 115 to a wellhead installation 150, which may include one or more subsea blow-out preventers 155. A wellbore 160 extends through the various earth strata including formation 110. In the embodiment of FIG. 1, wellbore tubular 165 is cemented within wellbore 160 by cement 170. In the illustrated embodiment, wellbore 160 has an initial, generally vertical portion 160*a* and a lower, generally deviated portion 160*b*, which is illustrated as being horizontal. It should be noted by those skilled in the art, however, that the fluid loss device 190 of the present disclosure is equally well-suited for use in other well configurations including, but not limited to, inclined wells, wells with restrictions, non-deviated wells and the like. Moreover, while the wellbore 160 is positioned below the sea floor 125 in the illustrated embodiment of FIG. 1, those skilled in the art understand that the principles of the present disclosure are equally as applicable to other subterranean formations, including those encompassing both areas below exposed earth and areas below earth covered by water such as ocean or fresh water.

In accordance with one embodiment of the disclosure, the fluid loss device 190 includes a rotating flapper positionable within the wellbore tubular 165 proximate one or more fracturing zones of interest 175*a*, 175*b*. When it is desired to fracture a particular subterranean zone of interest, such a one of the fracturing zones of interest 175*a*, 175*b*, the rotating flapper of the fluid loss device 190 may be closed. Thereafter, pressure within the wellbore 160 may be increased using the fracturing pump 135 and one or more different types of fracturing fluid and/or proppants, thereby forming fractures 180. With the fracture complete, other features of the fluid loss device 190, including the above discussed dissolvable member, may allow the flapper to reopen, thereby allowing production fluid from the fractures 180 to enter the wellbore tubular 165 and travel uphole.

While not shown, in certain embodiments the wellbore 160 is a main wellbore, and one or more lateral wellbores extend from the wellbore 160. In such an embodiment, a fluid loss device 190 could be located in each of the lateral wellbores. For example, the fluid loss devices 190 in each of the lateral wellbores could help isolate the one or more lateral wellbores from each other and the main wellbore 160 as the well system 100 is fractured (e.g., from a toe to heel fashion).

Referring now to FIG. 2, schematically illustrated is a fluid loss device 200 designed, manufactured, and operated according to one embodiment of the disclosure. The fluid loss device 200, in accordance with one embodiment, includes a wellbore tubular 210. The wellbore tubular 210 may be any known or hereafter discovered tubular used in a wellbore, including wellbore casing in one embodiment. The wellbore tubular 210, in one embodiment, is a collection of multiple wellbore tubulars connected together. Furthermore, the wellbore tubular may have an uphole region 210*a* and a downhole region 210*b*.

The fluid loss device 200, in accordance with one embodiment, includes a flapper seat 220 coupled to the wellbore tubular 210. The fluid loss device 200 additionally includes a flapper 230 associated with the flapper seat 220. In the illustrated embodiment, the flapper 230 is rotationally coupled to the flapper seat 220. The flapper 230 includes a distal tip 230*a*, as well as a rotation point 230*b*. In accordance with the disclosure, the flapper 230 is operable to rotate between an open position (e.g., that shown in FIG. 2) wherein the distal tip 230*a* of the flapper 230 is pointed toward the uphole region 210*a*, and a closed position (e.g., that shown in FIG. 4) wherein the distal tip 230*a* of the flapper 230 engages with the flapper seat 220. In the embodiment shown, a first spring member 240 is coupled to the flapper 230. The first spring member 240, in this embodiment, is configured to move the flapper 230 from the open position to the closed position.

In the embodiment of FIG. 2, an internal prop sleeve 250 is located in the wellbore tubular 210. The internal prop sleeve 250, in the illustrated embodiment, is operable to move from a first prop sleeve position holding the flapper 230 in the open position (e.g., that shown in FIG. 2) to a second prop sleeve position allowing the flapper 230 to rotate to the closed position. The internal prop sleeve 250 may be moved from the first prop sleeve position to the second prop sleeve position using a variety of different tools. In one embodiment, the internal prop sleeve 250 forms a part of the fluid loss device 200. In this embodiment, coiled tubing may be used to move the internal prop sleeve 250 from the first prop sleeve position to the second prop sleeve position. In another embodiment, the internal prop sleeve 250 is part of a disconnect tool located in the wellbore. In this embodiment, the first prop sleeve position is a disconnect tool run in hole position and the second prop sleeve position is a disconnect tool retrieval position. Accordingly, the fluid loss device 200 could be positioned within the wellbore using the disconnect tool, for example the disconnect tool having the internal prop sleeve in the run in hole position while positioning the fluid loss device 200 within the wellbore. Furthermore, the disconnect tool could be withdrawn uphole to a surface of the wellbore, effectively moving the internal prop sleeve 250 to the disconnect tool retrieval position, thereby allowing the flapper to move from the open position to the closed position, and activation fluid to encounter the dissolvable member and begin the dissolving process. The use of the disconnect tool including the internal prop sleeve 250, in at least one embodiment, eliminates a coil tubing run. Accordingly, the present disclosure should not be limited to any specific mechanism for moving the internal prop sleeve 250 from the first prop sleeve position to the second prop sleeve position.

The fluid loss device 200 illustrated in FIG. 2 additionally includes an opening sleeve 260 located in the wellbore tubular 210. The opening sleeve 260, in the illustrated embodiment, is operable to move from a first opening sleeve position allowing the flapper 230 to remain in the closed position when the internal prop sleeve 250 is in the second prop sleeve position, to a second opening sleeve position pushing and holding the flapper 230 in the open position when the internal prop sleeve 250 is no longer in the first prop sleeve position. The opening sleeve 260, in the illustrated embodiment, includes a second spring member 265 coupled thereto. The second spring member 265, in one or more embodiments, is coupled to a shoulder of the opening sleeve 260 and operable to move the opening sleeve from the first opening sleeve position to the second opening sleeve position. A spring force of the second spring member 265 may be specifically tailored for the fluid loss device 200. For example, the spring force of the second spring member 265 may be designed to overcome a specific amount of fluid pressure acting on the flapper 230 when the flapper 230 is in the closed position. Those skilled in the art will understand how to design the second spring member 265 having the appropriate spring force. The opening sleeve 260, in the illustrated embodiment, additionally includes a one-way locking mechanism 270 coupled thereto. The one-way locking mechanism 270 is designed to prevent the opening sleeve 260 from retreating back toward the first opening sleeve position after it has moved a specified distance towards the second opening sleeve position. In certain embodiments, the one-way locking mechanism 270 engages with protrusions 275 (e.g., teeth) on the opening sleeve 260.

The fluid loss device 200, in accordance with one embodiment of the disclosure, includes a dissolvable member 280 coupled to the opening sleeve 260. The dissolvable member 280, in at least one embodiment, is operable to fix the opening sleeve 260 in the first opening sleeve position when the internal prop sleeve 250 is in the first prop sleeve position and for a period of time after the internal prop sleeve 250 moves to the second prop sleeve position. After the period of time has elapsed, the dissolvable member 280 dissolves, triggering the opening sleeve 260 to move from the first opening sleeve position to the second opening sleeve position and pushing the flapper 230 from the closed position to the open position. For example, once the dissolvable member 280 no longer exists, the second spring member 265 is able to shift the opening sleeve 260 from the first opening sleeve position to the second opening sleeve position.

The dissolvable member 280 may vary in design and remain within the scope of the disclosure. For example, in the embodiment of FIG. 2, the dissolvable member 280 is a collection of one or more dissolvable balls that fix the opening sleeve 260 to the flapper seat 220. In yet another embodiment, the dissolvable member 280 is a dissolvable ring. Similarly, the material that the dissolvable member 280 may comprise may also vary. For example, depending on the type of activation fluid (e.g., brine in one embodiment) and the desired period of time before the dissolvable member 280 should dissolve, the material may vary. Furthermore, certain embodiments may employ coatings on the dissolvable member 280 to delay the dissolving process. Those skilled in the art of dissolvable materials would be able to design the dissolvable member 280 given the teachings herein.

In certain embodiments, such as that shown in FIG. 2, the dissolvable member 280 is located within a chamber 285. The chamber 285, in one embodiment, is positioned between the opening sleeve 260 and the wellbore tubular 210. The chamber 285, in one embodiment, is a fluid chamber. For example, the chamber 285 may include an inert fluid encapsulating the dissolvable member 280 when the fluid loss device 200 is originally run in hole. In certain embodiments, once the flapper 230 moves from the open position to the closed position, a flow path into the chamber 285 opens, thus allowing the activation fluid to enter the chamber 285 and begin the dissolving process.

In one or more embodiments, a pressure compensator 290 is located in the chamber 285. For example, in the embodiment of FIG. 2, the pressure compensator 290 is located in the chamber 285 downhole of the dissolvable member 280. Accordingly, when the flow path into the chamber 285 opens, the differential in pressure drives the pressure compensator 290 downhole, and thereby pulls the activation fluid into the chamber 285, once again beginning the dissolving process. In yet another embodiment, the chamber 285 is a low-pressure chamber or a vacuum chamber. In this embodiment, when the flow path into the chamber 285 opens, the low-pressure or vacuum draws the activation fluid into the chamber 285. In such an embodiment, a pressure compensator 290 may not be necessary.

The fluid loss device 200, in accordance with one embodiment of the disclosure, includes a plurality of isolation mechanisms 295 operable to isolate the dissolvable member 280 from the activation fluid when the internal prop sleeve 250 is in the first prop sleeve position. The plurality of isolation mechanisms 295 additionally allow the activation fluid to enter into the chamber 285 when the internal prop sleeve is in the second prop sleeve position. In the embodiment wherein the pressure compensator 290 is employed, the plurality of isolation mechanisms 295 allow the pressure compensator 290 to draw the activation fluid into the chamber 285 when the internal prop sleeve 250 is in the second prop sleeve position. The plurality of isolation mechanisms 295 may comprise a variety of different seals, but in at least one embodiment the plurality of isolation mechanisms 295 are a plurality of O-rings.

Figure 3:
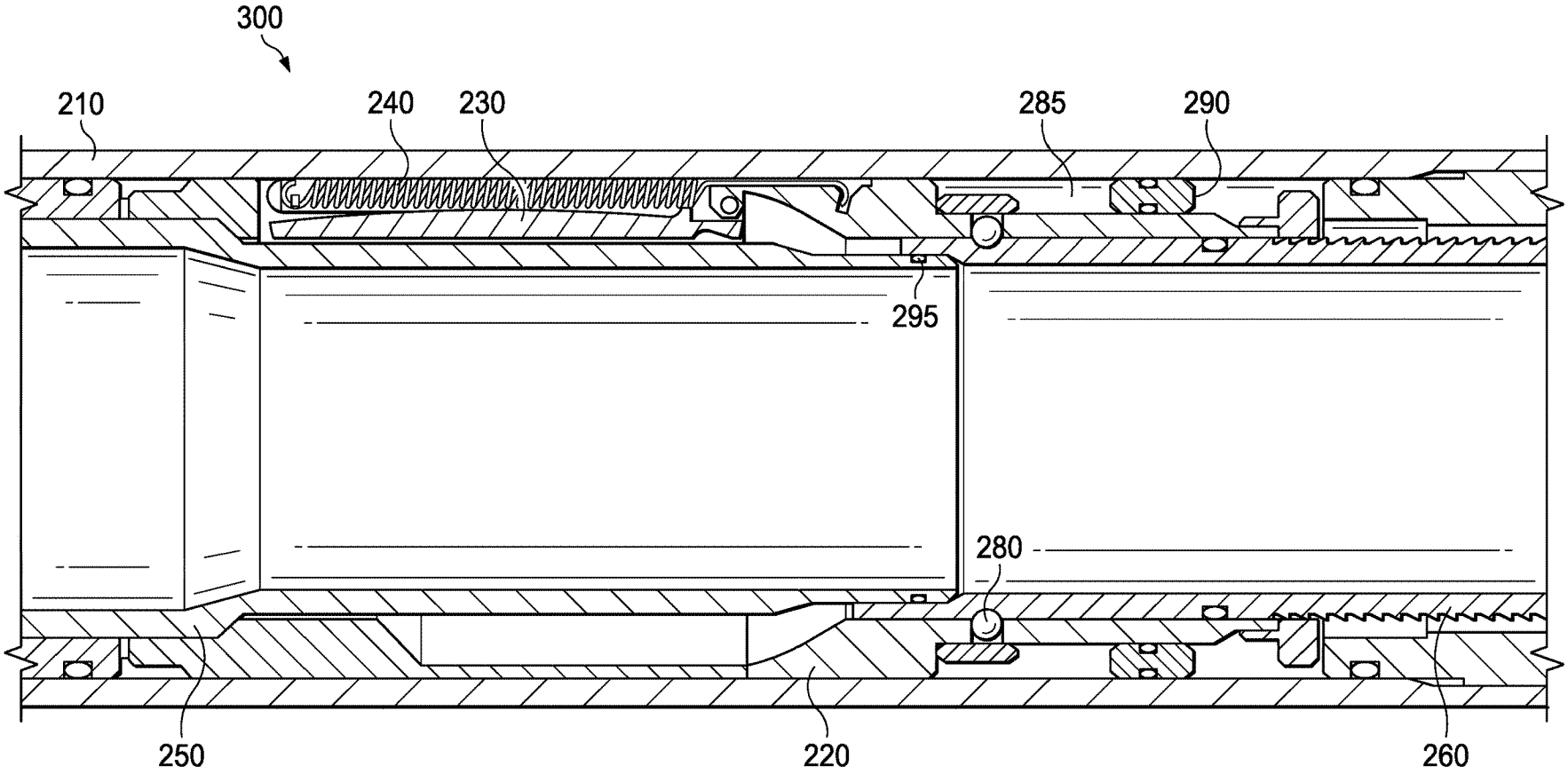

Turning to FIGS. 3 through 6, schematically illustrated is a fluid loss device 300 designed, manufactured and operated according to the present disclosure, at various different steps of fracturing a well system. The fluid loss device 300 is similar in many respects to the fluid loss device 200 illustrated in FIG. 2. Accordingly, like reference numbers have been used to illustrate similar, if not identical, features. The fluid loss device 300 illustrated in FIG. 3, is as it might be run-in hole. Accordingly, the internal prop sleeve 250 is located in a first prop sleeve position, thereby holding the flapper 230 in the open position. Similarly, the opening sleeve 260 is in its first opening sleeve position. As those skilled in the art now appreciate, the dissolvable member 280 is fixing the opening sleeve 260 in the first opening sleeve position. Moreover, in at least one embodiment, the dissolvable member 280 is encapsulated by an inert fluid filling the chamber 285, and the chamber 285 is sealed from any activation fluid using the plurality of isolation mechanisms 295, thus the dissolving process has not begun.

Figure 4:
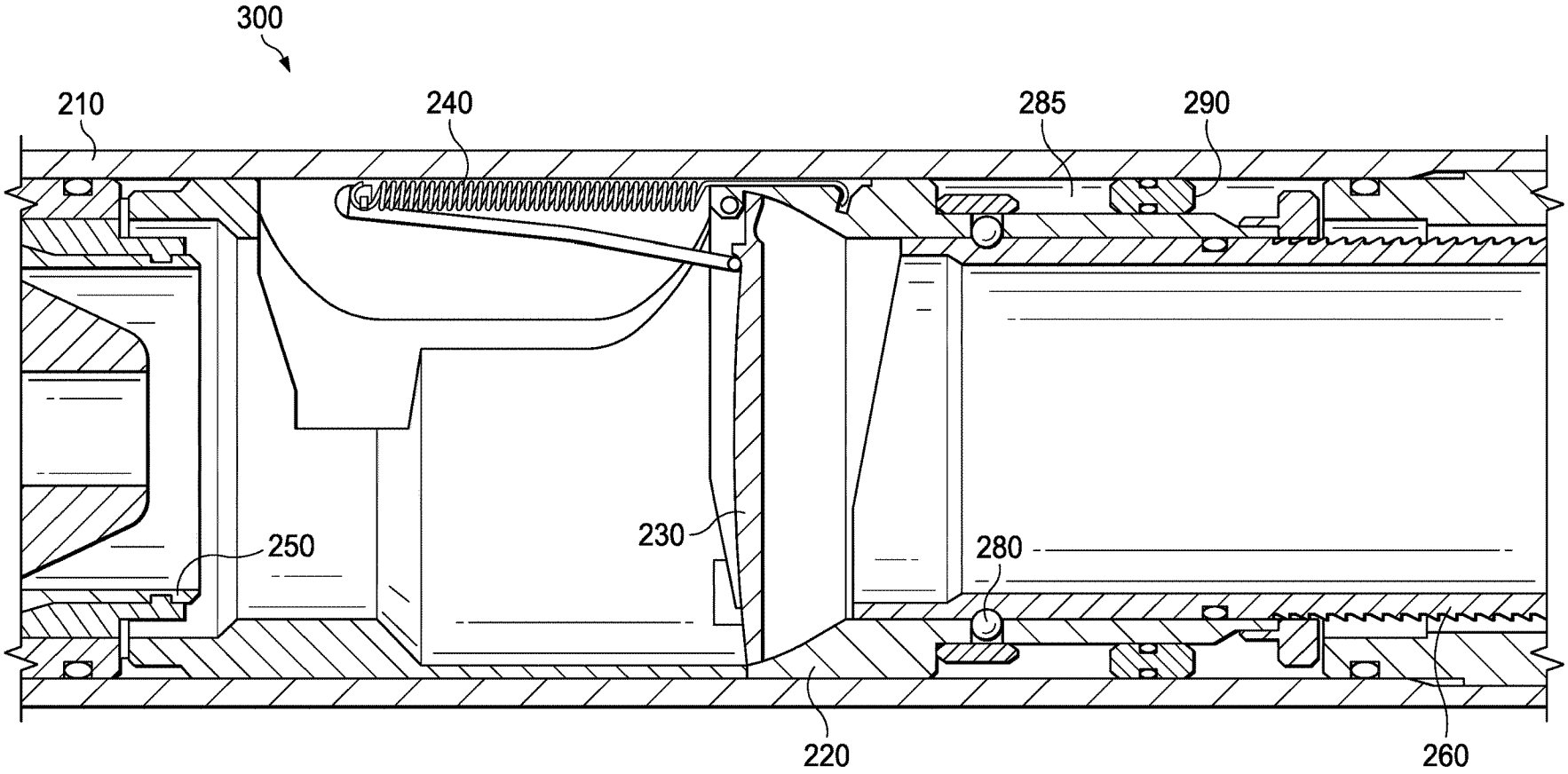

Turning to FIG. 4, illustrated is the fluid loss device 300 of FIG. 3 after withdrawing the internal prop sleeve 250 uphole. In this embodiment, the withdrawing allows the flapper 230 to move from the open position to the closed position, for example using the first spring member 240 and potentially fluid pressure from above. The withdrawing also allows the activation fluid to encounter the dissolvable member 280 and begin a dissolving process. At this stage, the flapper 230 is closed, and thus any necessary pressuring up upon the flapper 230 may occur. For example, at this stage a kill fluid may be circulated in to prevent the any undesired production before the well is ready.

Figure 5:
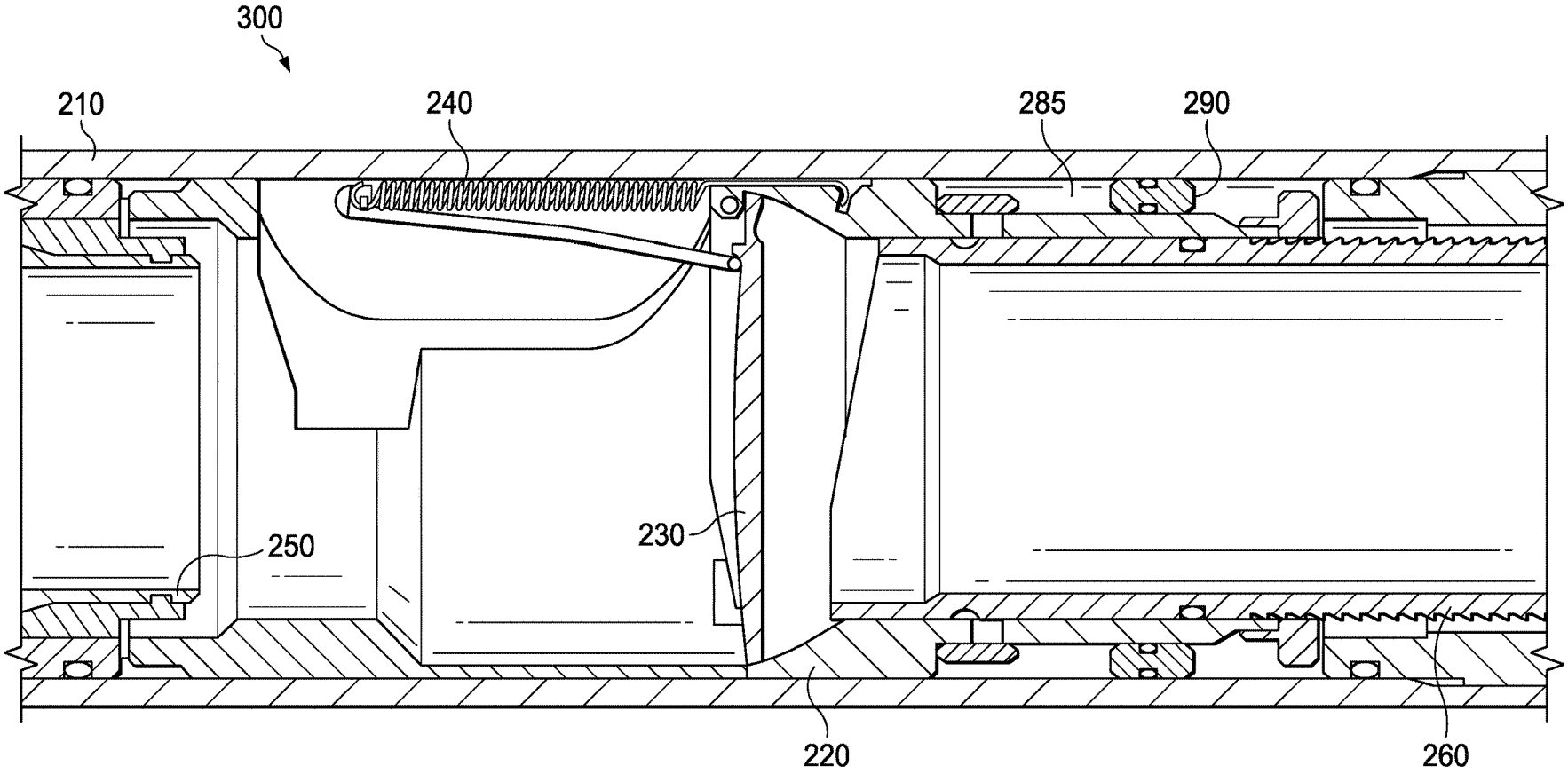

Turning to FIG. 5, illustrated is the fluid loss device 300 of FIG. 4 after a sufficient period of time has elapsed, such that the activation fluid has dissolved the dissolvable member 280. The dissolving of the dissolvable member 280 triggers the opening sleeve 260 to move from the first opening sleeve position toward the second opening sleeve position. As discussed above, the spring member (not shown) coupled to the opening sleeve 260 may urge the opening sleeve 260 uphole. In the embodiment of FIG. 5, fluid pressure remains on the flapper 230, thus the opening sleeve 260 cannot move the flapper 230 from the closed position to the open position.

Figure 6:
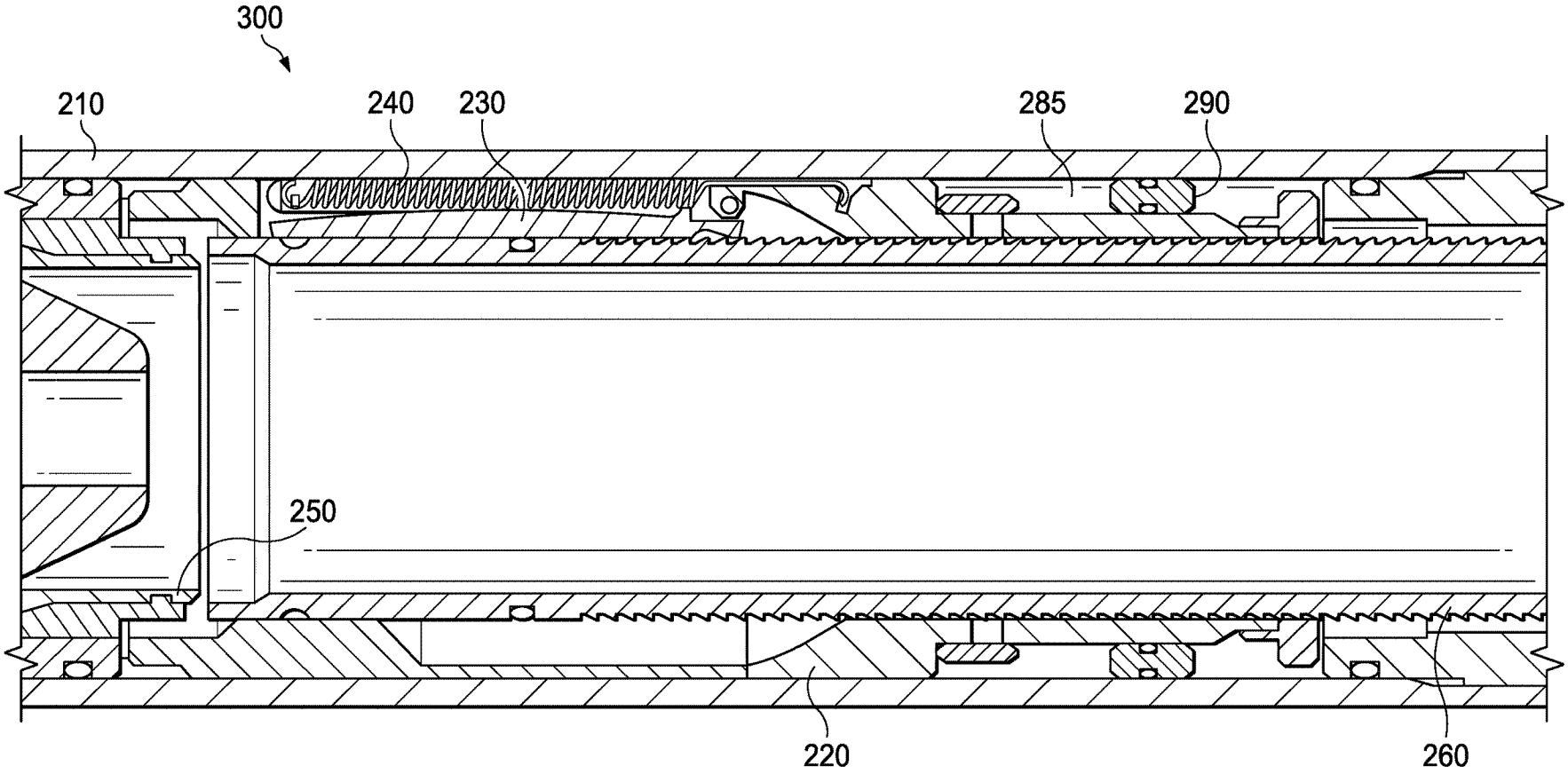

Turning to FIG. 6, illustrated is the fluid loss device 300 of FIG. 5 after reducing the fluid pressure on the flapper 230. At a point when the spring force of the spring member (not shown) urging the opening sleeve 260 uphole overcomes the fluid pressure on the flapper 230, the opening sleeve 260 moves from the first opening sleeve position to the second opening sleeve position. Accordingly, at this stage, the opening sleeve 260 holds the flapper 230 in the open position. At this stage, the fluid loss device 300 further allows full fluid communication.

Aspects disclosed herein include:

A. A fluid loss device, the fluid loss device including: 1) a wellbore tubular having an uphole region and a downhole region; 2) a flapper seat coupled to the wellbore tubular; 3) a flapper associated with the flapper seat, the flapper operable to rotate between an open position wherein a distal tip of the flapper is pointed toward the uphole region and a closed position wherein the distal tip of the flapper engages with the flapper seat; 3) an opening sleeve located in the wellbore tubular, the opening sleeve operable to move from a first opening sleeve position allowing the flapper to remain in the closed position to a second opening sleeve position pushing and holding the flapper in the open position; and 4) a dissolvable member coupled to the opening sleeve, the dissolvable member operable to fix the opening sleeve in the first opening sleeve position when the flapper is in the open position and for a period of time after the flapper moves to the closed position, and then dissolve triggering the opening sleeve to move from the first opening sleeve position to the second opening sleeve position to push and hold the flapper in the open position.

B. A well system, the well system including: 1) a wellbore extending through one or more subterranean formations; 2) a wellbore tubular located within the wellbore, the wellbore tubular having one or more fracturing ports located at a fracturing zone of interest; and 3) a fluid loss device positioned proximate the fracturing zone of interest, the fluid loss device, including: a) a flapper seat coupled to the wellbore tubular; b) a flapper associated with the flapper seat, the flapper operable to rotate between an open position wherein a distal tip of the flapper is pointed uphole and a closed position wherein the distal tip of the flapper engages with the flapper seat; c) an opening sleeve located in the wellbore tubular, the opening sleeve operable to move from a first opening sleeve position allowing the flapper to remain in the closed position to a second opening sleeve position pushing and holding the flapper in the open position; and d) a dissolvable member coupled to the opening sleeve, the dissolvable member operable to fix the opening sleeve in the first opening sleeve position when the flapper is in the open position and for a period of time after the flapper moves to the closed position, and then dissolve triggering the opening sleeve to move from the first opening sleeve position to the second opening sleeve position to push and hold the flapper in the open position.

C. A method for fracturing a well system, the method including: 1) positioning a fluid loss device within a wellbore extending into one or more subterranean formations, the fluid loss device located in a wellbore tubular and proximate a fracturing zone of interest in the wellbore, the fluid loss device including; a) a flapper seat coupled to the wellbore tubular; b) a flapper associated with the flapper seat, the flapper operable to rotate between an open position wherein a distal tip of the flapper is pointed uphole and a closed position wherein the distal tip of the flapper engages with the flapper seat; c) an internal prop sleeve located in the wellbore tubular, the internal prop sleeve operable to move from a first prop sleeve position holding the flapper in the open position to a second prop sleeve position allowing the flapper to rotate to the closed position; d) an opening sleeve located in the wellbore tubular, the opening sleeve operable to move from a first opening sleeve position allowing the flapper to remain in the closed position when the internal prop sleeve is in the second prop sleeve position and to a second opening sleeve position pushing and holding the flapper in the open position when the internal prop sleeve is in the second prop sleeve position; and e) a dissolvable member coupled to the opening sleeve, the dissolvable member operable to fix the opening sleeve in the first opening sleeve position while the internal prop sleeve is in the first prop sleeve position and for a period of time after the internal prop sleeve moves to the second prop sleeve position, and then dissolve triggering the opening sleeve to move from the first opening sleeve position to the second opening sleeve position; 2) withdrawing the internal prop sleeve uphole, the withdrawing allowing the flapper to move from the open position to the closed position, and activation fluid to encounter the dissolvable member and begin a dissolving process; and 3) fracturing the fracturing zone of interest with the flapper in the closed position, and then after a period of time the activation member dissolving and allowing the opening sleeve to move from the first opening sleeve position to the second opening sleeve position and pushing and holding the flapper in the open position.

Aspects A, B, and C may have one or more of the following additional elements in combination: Element 1: wherein the dissolvable member is located within a chamber positioned between the opening sleeve and the wellbore tubular and isolated from wellbore fluid when the flapper is in the open position. Element 2: wherein the chamber includes an inert fluid encapsulating the dissolvable member. Element 3: further including a pressure compensator located in the chamber downhole of the dissolvable member. Element 4: wherein the pressure compensator is operable to draw activation fluid into the chamber to begin the dissolving process when the flapper moves from the open position to the closed position. Element 5: further including a plurality of isolation mechanisms operable to isolate the dissolvable member from the activation fluid when the flapper is in the open position and allow the pressure compensator to draw the activation fluid into the chamber when the flapper is in the closed position. Element 6: wherein the plurality of isolation mechanisms are a plurality of O-rings. Element 7: wherein the dissolvable member fixes the opening sleeve to the flapper seat to fix the opening sleeve in the first opening sleeve position. Element 8: wherein the dissolvable member is a dissolvable ball. Element 9: wherein the dissolvable member is a dissolvable ring. Element 10: further including a spring member coupled to the flapper, the spring member configured to move the flapper from the open position to the closed position when not propped in the open position by an internal prop sleeve. Element 11: wherein the spring member is a first spring member, and further including a second spring member coupled to the opening sleeve and operable to move the opening sleeve from the first opening sleeve position to the second opening sleeve position when the dissolvable member dissolves. Element 12: wherein the flapper is rotationally coupled to the flapper seat. Element 13: further including a one-way locking mechanism coupled to the opening sleeve, the one-way locking mechanism preventing the opening sleeve from retreating back toward the first opening sleeve position. Element 14: wherein the period of time is from one hour to ten days. Element 15: wherein the period of time is from two hours to two days. Element 16: further including an internal prop sleeve located in the wellbore tubular, the internal prop sleeve operable to move from a first prop sleeve position holding the flapper in the open position to a second prop sleeve position allowing the flapper to rotate to the closed position, and further wherein the opening sleeve is operable to move from a first opening sleeve position allowing the flapper to remain in the closed position when the internal prop sleeve is in the second prop sleeve position to a second opening sleeve position pushing and holding the flapper in the open position when the internal prop sleeve is no longer in the first prop sleeve position. Element 17: wherein the dissolvable member is located within a chamber positioned between the opening sleeve and the wellbore tubular, the chamber including an inert fluid encapsulating the dissolvable member. Element 18: further including a pressure compensator located in the chamber downhole of the dissolvable member, the pressure compensator operable to draw activation fluid into the chamber to begin the dissolving process when the flapper moves from the open position to the closed position. Element 19: further including an internal prop sleeve located in the wellbore tubular, the internal prop sleeve operable to move from a first prop sleeve position holding the flapper in the open position to a second prop sleeve position allowing the flapper to rotate to the closed position, and further wherein the opening sleeve is operable to move from a first opening sleeve position allowing the flapper to remain in the closed position when the internal prop sleeve is in the second prop sleeve position to a second opening sleeve position pushing and holding the flapper in the open position when the internal prop sleeve is no longer in the first prop sleeve position. Element 20: wherein the internal prop sleeve is part of a disconnect tool located in the wellbore tubular, the fluid loss device operable to be run in hole with the disconnect tool, and further wherein the first prop sleeve position is a disconnect tool run in hole position and the second prop sleeve position is a disconnect tool retrieval position. Element 21: wherein the internal prop sleeve is part of a disconnect tool located in the wellbore tubular, the first prop sleeve position being a disconnect tool run in hole position and the second prop sleeve position being a disconnect tool retrieval position, and further wherein positioning the fluid loss device in the wellbore includes positioning the fluid loss device within the wellbore using the disconnect tool having the internal prop sleeve in the disconnect tool run in hole position. Element 22: wherein withdrawing the internal prop sleeve uphole includes retrieving the disconnect tool uphole to a surface of the wellbore, the retrieving moving the internal prop sleeve to the disconnect tool retrieval position, thereby allowing the flapper to move from the open position to the closed position, and activation fluid to encounter the dissolvable member and begin the dissolving process.

Those skilled in the art to which this application relates will appreciate that other and further additions, deletions, substitutions and modifications may be made to the described embodiments.

What is claimed is:

1. A fluid loss device, comprising:

a wellbore tubular having an uphole region and a downhole region;

a flapper seat coupled to the wellbore tubular;

a flapper associated with the flapper seat, the flapper operable to rotate between an open position wherein a distal tip of the flapper is pointed toward the uphole region and a closed position wherein the distal tip of the flapper engages with the flapper seat;

an opening sleeve located in the wellbore tubular, the opening sleeve operable to move from a first opening sleeve position allowing the flapper to remain in the closed position to a second opening sleeve position pushing and holding the flapper in the open position; and a dissolvable member coupled to the opening sleeve, the dissolvable member operable to fix the opening sleeve in the first opening sleeve position when the flapper is in the open position and for a period of time after the flapper moves to the closed position, and then dissolve triggering the opening sleeve to move from the first opening sleeve position to the second opening sleeve position to push and hold the flapper in the open position, wherein the dissolvable member is located within a chamber positioned between the opening sleeve and the wellbore tubular and isolated from wellbore fluid when the flapper is in the open position.

2. The fluid loss device as recited in claim 1, wherein the chamber includes an inert fluid encapsulating the dissolvable member.

3. The fluid loss device as recited in claim 1, further including a pressure compensator located in the chamber downhole of the dissolvable member.

4. The fluid loss device as recited in claim 3, wherein the pressure compensator is operable to draw activation fluid into the chamber to begin the dissolving process when the flapper moves from the open position to the closed position.

5. The fluid loss device as recited in claim 4, further including a plurality of isolation mechanisms operable to isolate the dissolvable member from the activation fluid when the flapper is in the open position and allow the pressure compensator to draw the activation fluid into the chamber when the flapper is in the closed position.

6. The fluid loss device as recited in claim 5, wherein the plurality of isolation mechanisms are a plurality of O-rings.

7. The fluid loss device as recited in claim 1, wherein the dissolvable member fixes the opening sleeve to the flapper seat to fix the opening sleeve in the first opening sleeve position.

8. The fluid loss device as recited in claim 1, wherein the dissolvable member is a dissolvable ball.

9. The fluid loss device as recited in claim 1, wherein the dissolvable member is a dissolvable ring.

10. The fluid loss device as recited in claim 1, further including a spring member coupled to the flapper, the spring member configured to move the flapper from the open position to the closed position when not propped in the open position by an internal prop sleeve.

11. The fluid loss device as recited in claim 10, wherein the spring member is a first spring member, and further including a second spring member coupled to the opening sleeve and operable to move the opening sleeve from the first opening sleeve position to the second opening sleeve position when the dissolvable member dissolves.

12. The fluid loss device as recited in claim 1, wherein the flapper is rotationally coupled to the flapper seat.

13. The fluid loss device as recited in claim 1, further including a one-way locking mechanism coupled to the opening sleeve, the one-way locking mechanism preventing the opening sleeve from retreating back toward the first opening sleeve position.

14. The fluid loss device as recited in claim 1, wherein the period of time is from one hour to ten days.

15. The fluid loss device as recited in claim 1, wherein the period of time is from two hours to two days.

16. The fluid loss device as recited in claim 1, further including an internal prop sleeve located in the wellbore tubular, the internal prop sleeve operable to move from a first prop sleeve position holding the flapper in the open position to a second prop sleeve position allowing the flapper to rotate to the closed position, and further wherein the opening sleeve is operable to move from a first opening sleeve position allowing the flapper to remain in the closed position when the internal prop sleeve is in the second prop sleeve position to a second opening sleeve position pushing and holding the flapper in the open position when the internal prop sleeve is no longer in the first prop sleeve position.

17. A well system, comprising:

a wellbore extending through one or more subterranean formations;

a wellbore tubular located within the wellbore, the wellbore tubular having one or more fracturing ports located at a fracturing zone of interest; and a fluid loss device positioned proximate the fracturing zone of interest, the fluid loss device, including:

a flapper seat coupled to the wellbore tubular;

a flapper associated with the flapper seat, the flapper operable to rotate between an open position wherein a distal tip of the flapper is pointed uphole and a closed position wherein the distal tip of the flapper engages with the flapper seat;

an opening sleeve located in the wellbore tubular, the opening sleeve operable to move from a first opening sleeve position allowing the flapper to remain in the closed position to a second opening sleeve position pushing and holding the flapper in the open position; and a dissolvable member coupled to the opening sleeve, the dissolvable member operable to fix the opening sleeve in the first opening sleeve position when the flapper is in the open position and for a period of time after the flapper moves to the closed position, and then dissolve triggering the opening sleeve to move from the first opening sleeve position to the second opening sleeve position to push and hold the flapper in the open position.

18. The well system as recited in claim 17, wherein the dissolvable member is located within a chamber positioned between the opening sleeve and the wellbore tubular, the chamber including an inert fluid encapsulating the dissolvable member.

19. The well system as recited in claim 18, further including a pressure compensator located in the chamber downhole of the dissolvable member, the pressure compensator operable to draw activation fluid into the chamber to begin the dissolving process when the flapper moves from the open position to the closed position.

20. The well system as recited in claim 17, further including an internal prop sleeve located in the wellbore tubular, the internal prop sleeve operable to move from a first prop sleeve position holding the flapper in the open position to a second prop sleeve position allowing the flapper to rotate to the closed position, and further wherein the opening sleeve is operable to move from a first opening sleeve position allowing the flapper to remain in the closed position when the internal prop sleeve is in the second prop sleeve position to a second opening sleeve position pushing and holding the flapper in the open position when the internal prop sleeve is no longer in the first prop sleeve position.

21. The well system as recited in claim 20, wherein the internal prop sleeve is part of a disconnect tool located in the wellbore tubular, the fluid loss device operable to be run in hole with the disconnect tool, and further wherein the first prop sleeve position is a disconnect tool run in hole position and the second prop sleeve position is a disconnect tool retrieval position.

22. A method for fracturing a well system, comprising:

positioning a fluid loss device within a wellbore extending into one or more subterranean formations, the fluid loss device located in a wellbore tubular and proximate a fracturing zone of interest in the wellbore, the fluid loss device including;

a flapper seat coupled to the wellbore tubular;

a flapper associated with the flapper seat, the flapper operable to rotate between an open position wherein a distal tip of the flapper is pointed uphole and a closed position wherein the distal tip of the flapper engages with the flapper seat;

an internal prop sleeve located in the wellbore tubular, the internal prop sleeve operable to move from a first prop sleeve position holding the flapper in the open position to a second prop sleeve position allowing the flapper to rotate to the closed position;

an opening sleeve located in the wellbore tubular, the opening sleeve operable to move from a first opening sleeve position allowing the flapper to remain in the closed position when the internal prop sleeve is in the second prop sleeve position and to a second opening sleeve position pushing and holding the flapper in the open position when the internal prop sleeve is in the second prop sleeve position; and a dissolvable member coupled to the opening sleeve, the dissolvable member operable to fix the opening sleeve in the first opening sleeve position while the internal prop sleeve is in the first prop sleeve position and for a period of time after the internal prop sleeve moves to the second prop sleeve position, and then dissolve triggering the opening sleeve to move from the first opening sleeve position to the second opening sleeve position;

withdrawing the internal prop sleeve uphole, the withdrawing allowing the flapper to move from the open position to the closed position, and activation fluid to encounter the dissolvable member and begin a dissolving process; and fracturing the fracturing zone of interest with the flapper in the closed position, and then after a period of time the activation member dissolving and allowing the opening sleeve to move from the first opening sleeve position to the second opening sleeve position and pushing and holding the flapper in the open position.

23. The method as recited in claim 22, wherein the internal prop sleeve is part of a disconnect tool located in the wellbore tubular, the first prop sleeve position being a disconnect tool run in hole position and the second prop sleeve position being a disconnect tool retrieval position, and further wherein positioning the fluid loss device in the wellbore includes positioning the fluid loss device within the wellbore using the disconnect tool having the internal prop sleeve in the disconnect tool run in hole position.

24. The method as recited in claim 23, wherein withdrawing the internal prop sleeve uphole includes retrieving the disconnect tool uphole to a surface of the wellbore, the retrieving moving the internal prop sleeve to the disconnect tool retrieval position, thereby allowing the flapper to move from the open position to the closed position, and activation fluid to encounter the dissolvable member and begin the dissolving process.

25. A fluid loss device, comprising:

a wellbore tubular having an uphole region and a downhole region;

a flapper seat coupled to the wellbore tubular;

a flapper associated with the flapper seat, the flapper operable to rotate between an open position wherein a distal tip of the flapper is pointed toward the uphole region and a closed position wherein the distal tip of the flapper engages with the flapper seat;

an internal prop sleeve located in the wellbore tubular, the internal prop sleeve operable to move from a first prop sleeve position holding the flapper in the open position to a second prop sleeve position allowing the flapper to rotate to the closed position an opening sleeve located in the wellbore tubular, the opening sleeve operable to move from a first opening sleeve position allowing the flapper to remain in the closed position when the internal prop sleeve is in the second prop sleeve position and to a second opening sleeve position pushing and holding the flapper in the open position when the internal prop sleeve is in the second prop sleeve position; and a dissolvable member coupled to the opening sleeve, the dissolvable member operable to fix the opening sleeve in the first opening sleeve position when the flapper is in the open position and for a period of time after the flapper moves to the closed position, and then dissolve triggering the opening sleeve to move from the first opening sleeve position to the second opening sleeve position to push and hold the flapper in the open position.

* * * * *